US006126422A

United States Patent [19]

Crum et al.

[11] Patent Number: 6,126,422

[45] Date of Patent: Oct. 3, 2000

[54] TIP SEAL FOR SCROLL TYPE COMPRESSOR AND MANUFACTURING METHOD THEREFOR

[75] Inventors: Daniel R. Crum; William L. Stichman, both of La Crosse, Wis.

[73] Assignee: American Standard Inc., Piscataway, N.J.

[21] Appl. No.: 08/957,601

[22] Filed: Oct. 24, 1997

[51] Int. Cl.[7] ..... F01C 1/02; F16J 15/34

[52] U.S. Cl. ..... 418/55.4; 418/140; 277/96.1; 277/204

[58] Field of Search ..... 418/55.4, 140; 277/204, 96.1, DIG. 6

[56] References Cited

U.S. PATENT DOCUMENTS

| | | | |
|---|---|---|---|
| 801,182 | 10/1905 | Creux . | |
| 3,994,636 | 11/1976 | McCullough et al. | 418/55 |
| 4,415,317 | 11/1983 | Butterworth | 418/55 |
| 4,453,899 | 6/1984 | Hiraga et al. | 418/55 |
| 4,627,799 | 12/1986 | Terauchi | 418/55 |
| 4,767,293 | 8/1988 | Caillat et al. | 418/57 |
| 4,883,413 | 11/1989 | Perevuznik et al. | 418/55 |
| 5,037,281 | 8/1991 | Lane et al. | 418/55.4 |
| 5,040,956 | 8/1991 | Barito et al. | 418/1 |
| 5,362,217 | 11/1994 | Jetzer et al. | 418/55.4 |
| 5,364,247 | 11/1994 | Fukanuma et al. | 418/55.4 X |
| 5,575,634 | 11/1996 | Tanaka et al. | 418/55.4 |
| 5,584,678 | 12/1996 | Hirooka et al. | 418/55.2 |
| 5,632,612 | 5/1997 | Shaffer | 418/55.4 |
| 5,636,976 | 6/1997 | Niwa et al. | 418/55.4 |

*Primary Examiner*—Hoang Nguyen
*Attorney, Agent, or Firm*—William J. Beres; William O'Driscoll; Peter D. Ferguson

[57] ABSTRACT

A single piece tip seal for use in scroll compressors is produced using a polyetheretherkeytone base material injected into a mold having two ingates to the mold cavity.

9 Claims, 3 Drawing Sheets

FIG. 2
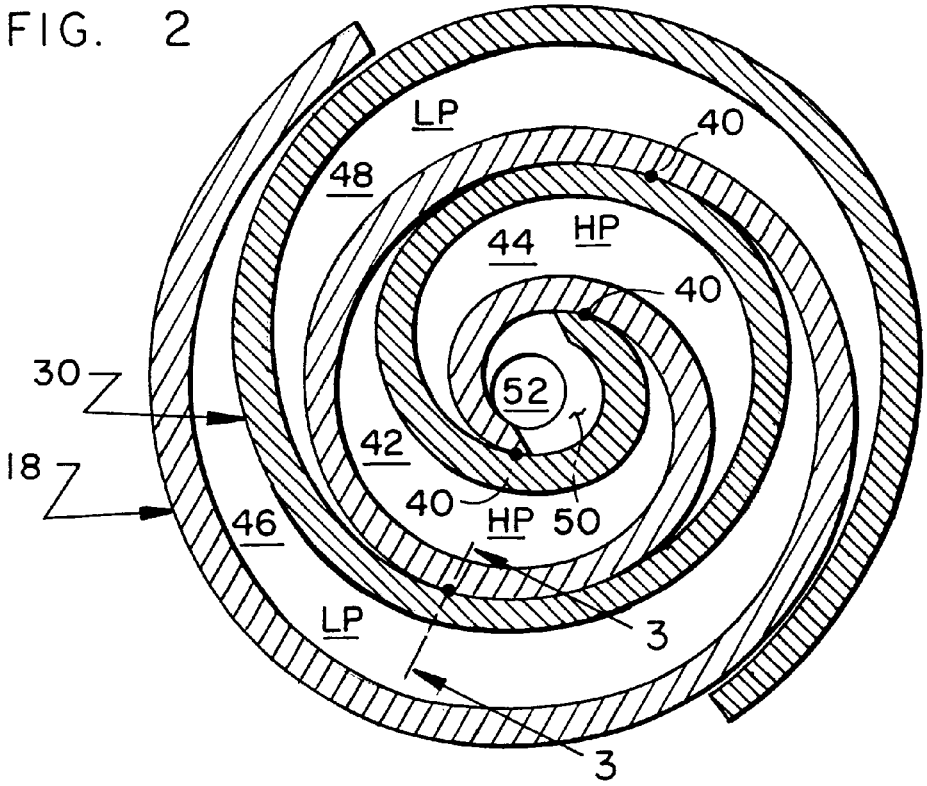
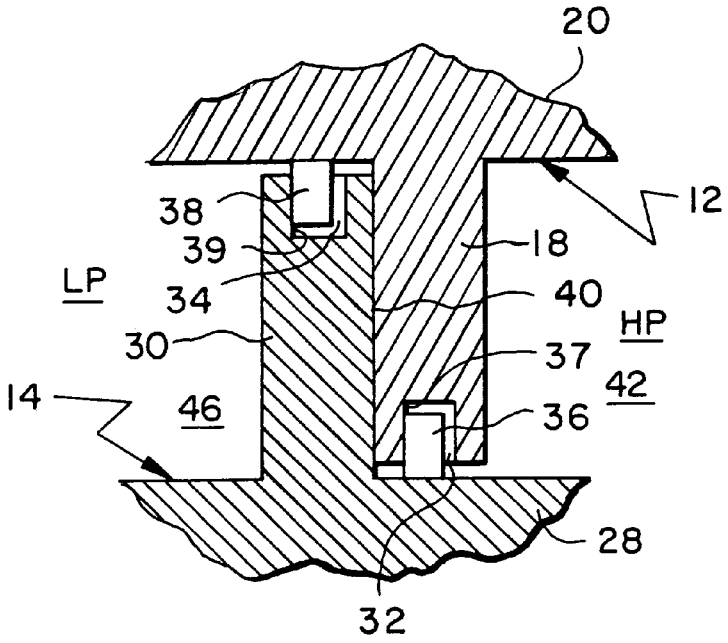
FIG. 3

TIP SEAL FOR SCROLL TYPE COMPRESSOR AND MANUFACTURING METHOD THEREFOR

BACKGROUND OF THE INVENTION

The present invention relates generally to the field of compressors of the scroll type. It is specifically directed to an element for effecting sealing between the axial tip portion of a scroll wrap element and the end plate of the opposing scroll member as well as to a method of injection molding such tip seal elements.

In scroll compressors, a drive motor typically drives one of the two scroll members that comprise the compression mechanism. Each scroll member has an end plate from which an involute wrap extends. The involute wraps of the pair of scroll members are interleaved and are constrained, by use of a device such as an Oldham coupling, to relative motion such that one scroll member orbits with respect to the other.

Such orbital motion, when in the proper direction, causes the cyclical creation of open suction pockets at the radially outward ends of the interleaved involute wraps of the scroll members. During compressor operation, such pockets fill with suction gas, close and are displaced radially inward, while decreasing in volume, thereby compressing the gas trapped in them. The compression pockets are ultimately displaced into communication with a discharge port, located at the center of the scroll set, and compressed gas is expelled therethrough.

Once closed off from the suction area but prior to being displaced into communication with the discharge port, the compression pockets formed by the scroll members must become and remain sealed if the compression process is to be efficient. Failure to control leakage from higher pressure compression pockets to lower pressure compression pockets or back to the suction area of the compressor decreases compressor efficiency. On the other hand, the use of excessive force to seal such pockets through direct contact of the surfaces of one scroll member with opposing surfaces of the other scroll member places an unproductive load on the compressor drive motor which likewise reduces compressor efficiency.

The sealing of scroll compression pockets is accomplished by the moving flank-to-flank line contact or near contact of the upstanding scroll wraps of the two scroll members as well as contact between the tip of each scroll wrap with the end plate of the opposing scroll member. Depending upon design choices made with respect to a scroll compressor, actual flank-to-flank contact may or may not be provided for. In so-called "fixed throw" scroll compressors the scroll wraps are aligned such that their flanks are maintained in near contact rather than actual contact.

Likewise depending on the design of the compressor, sealing between the tip of an involute wrap of one scroll member and the end plate of an opposing scroll member may be achieved by direct wrap tip to opposing end plate contact or by the use of a tip seal ensconced in a groove defined in the tip of the involute wrap. In most compressors, lubricant is supplied to the scroll set, most often carried in the gas undergoing compression or through a lubricant injection arrangement, to both lubricate the surfaces of the scroll members that are in contact with each other and to seal the compression pockets defined by the scroll members at their contact or at near contact locations.

U.S. Pat. No. 801,182 long ago disclosed the use of tip seals in scroll apparatus. U.S. Pat. No. 3,994,636 is illustrative of subsequent yet still very early developments relating to the use of tip seals therein. Both patents, which are incorporated herein by reference, suggest, among other things, tip seal elements fabricated from a single strip of material. The '636 patent suggests the use of both metallic and nonmetallic materials in tip seal fabrication. Both of these patents, however, predated by decades the introduction of scroll apparatus into large scale commercial production and, as such, were speculative in their teachings concerning tip seals and their design, fabrication and use.

U.S. Pat. No. 4,415,317, assigned to the assignee of the present invention and incorporated herein by reference, teaches a tip seal for scroll apparatus fabricated from a plurality of adjacent strips of material. The tip seal design of the '317 patent has proven to be both producible and effective in application and came to be used in among the very first scroll compressors manufactured for commercial use in the 1980's.

The '317 patent noted, at the time of its writing, that the use of a unitary piece of material to form a tip seal element, while seemingly advantageous in many respects, had drawbacks. Among those drawbacks was the fact that such pieces had to be machined or otherwise formed to the precise involute shape of the groove in the tip of an involute wrap in which they were required to be inserted in order to afford proper sealing. The '317 patent noted that the necessity for machining or other special formation of tip seals from a unitary piece of material brought with it disadvantages relating to the difficulty and expense of the machining operations involved or, in the case of the plastics then available, deficiencies associated with the elasticity and wearability of the material. The laminated tip seal of the '317 patent, which was comprised of side-by-side strips of steel, provided both the robustness and flexibility necessary to face the rigorous and relatively high temperature applications in which it was used.

More recently, newer engineered materials have been developed which have, in fact, permitted the fabrication of sufficiently flexible, robust and heat resistant unitary tip seals for use in scroll compressors that are moldable and do not require finish machining. Exemplary in that regard are the tip seals and teachings of very recent U.S. Pat. Nos. 5,575,634 and 5,636,976 which are likewise incorporated herein by reference.

The '976 patent is particularly noteworthy both with respect to the invention it claims and the art it describes in its "Background of the Invention" portion. In its "Background of the Invention", the '976 patent identifies the existence of Japanese patent documents related to injection molded tip seals, one such document (JP-A-4-262087) teaching, according to the '976 patent, a conventional method of manufacturing a tip seal with a synthetic resin where the synthetic resin is "supplied up to both ends of a mold for a scroll-shaped tip seal by providing a side gate, through which the synthetic resin is to be injected, on a side of the mold for the tip seal at the substantially intermediate portion of the entire length thereof".

The '976 patent goes on to state, with respect to that particular method of manufacturing, that "a convex portion m is formed as a gate trace on a side of a tip seal", that particular tip seal and concept being illustrated in FIG. 6 of the '976 patent. That convexity in the sidewall portion of the tip seal is said to adversely affect the sealing properties of such tip seals. That particular problem and adverse effect was solved, according to the '976 patent "by injection molding with a side gate provided at a portion which is an outside end of a mold for a scroll-shaped tip seal in a method disclosed in JP-A-6-137285, so that a sealing property of the tip seal is improved by preventing the formation of a gate trace on a side of the tip seal". The '976 patent then goes on to identify still other problems associated with methodology of JP-A-6-137285 and describes, as its invention, a tip seal and methodology to overcome those still other problems.

Despite all of these teachings, certain newer and even more advantageous "engineered materials" have been developed. These materials have characteristics which, while making them particularly appropriate for use in tip seal applications, are so highly viscous in the "fluid" state that they must be in to permit their injection into a mold cavity, that existing injection molding methodologies are incapable of permitting the fabrication of tip seals from such materials. This incapability results from a failure to be able to force the base material completely into the small cross-section (often nominally 0.01 square inches or so), relatively very long (on the order of one foot) involute-shaped cavity that the mold for a single piece tip seal must define.

As such, the need exists for economical single piece tip seals manufactured from engineered materials having superior wear and heat resistance characteristics to those of existing tip seals and for a methodology of forming such tip seals through an injection molding process.

SUMMARY OF THE INVENTION

It is an object of the present invention to provide a unitary tip seal element for a scroll compressor and a method of its manufacture.

It is another object of the present invention to provide a single piece tip seal for use in a scroll compressor which has superior wear characteristics when in contact with gray cast iron, such cast iron being the material from which at least one of the scroll members of the scroll compressor is fabricated.

It is a further object of the present invention to provide a single piece tip seal for a scroll compressor which is relatively flexible and easy to install in the groove defined in the tip of the involute wrap of the scroll member in which it resides.

It is another object of the present invention to provide a unitary tip seal for a scroll compressor which is economic of manufacture yet which has wear resistance characteristics that are equal or superior to existing tip seals.

It is a still further object of the present invention to provide a methodology by which a highly viscous material can be directed into a mold for a tip seal used in a scroll compressor such that the distance the viscous material must flow is minimized yet the tip seal is essentially homogeneous.

It is still another object of the present invention to provide both a method of molding and a mold for a tip seal for a scroll compressor which employs two ingates to the mold cavity positioned to minimize the distance which the highly viscous tip seal base material must flow, which eliminates convexities on the sidewalls of the tip seal at the ingate locations and which results in a unitary tip seal element in which only a single "butt" joint exists.

These and other objects of the present invention, which will be appreciated by reference to the Description of the Preferred Embodiment which follows and the attached drawing figures, are achieved by a tip seal produced using a carbon fiber, polytetrafluoroethylene alloyed polyetheretherketone (PEEK) material in an injection molding process that causes the inflow of the base material into the mold cavity through two ingates. By the use of two ingates appropriately positioned along the length of the cavity which defines the shape and volume of the tip seal in its mold, the total mold cavity length is effectively quartered for material flow purposes and the highly viscous tip seal material in all cases flows, at maximum, a distance which is equidistant from either ingate.

Further, by forming the mold such that a slight concavity in the tip seal sidewalls results at the location of the ingates where roughened surfaces (gate traces) will exist due to the clipping or breaking off of excess material at the location of the ingate to the tip seal mold cavity, the convexities noted with respect to prior tip seal injection molding techniques and the adverse affects of such convexities on the sealing properties of the tip seal are avoided. As a result, an economically fabricated, essentially homogeneous, single piece tip seal having superior wear resistance characteristics results.

DESCRIPTION OF THE DRAWING FIGURES

FIG. 2 is a cross-sectional view taken along lines 2—2 of FIG. 1.

FIG. 3 is an enlarged partial view of the interleaved wraps of the scroll apparatus of FIG. 1 taken along line 3—3 of FIG. 2.

DESCRIPTION OF THE PREFERRED EMBODIMENT

Figure 1:
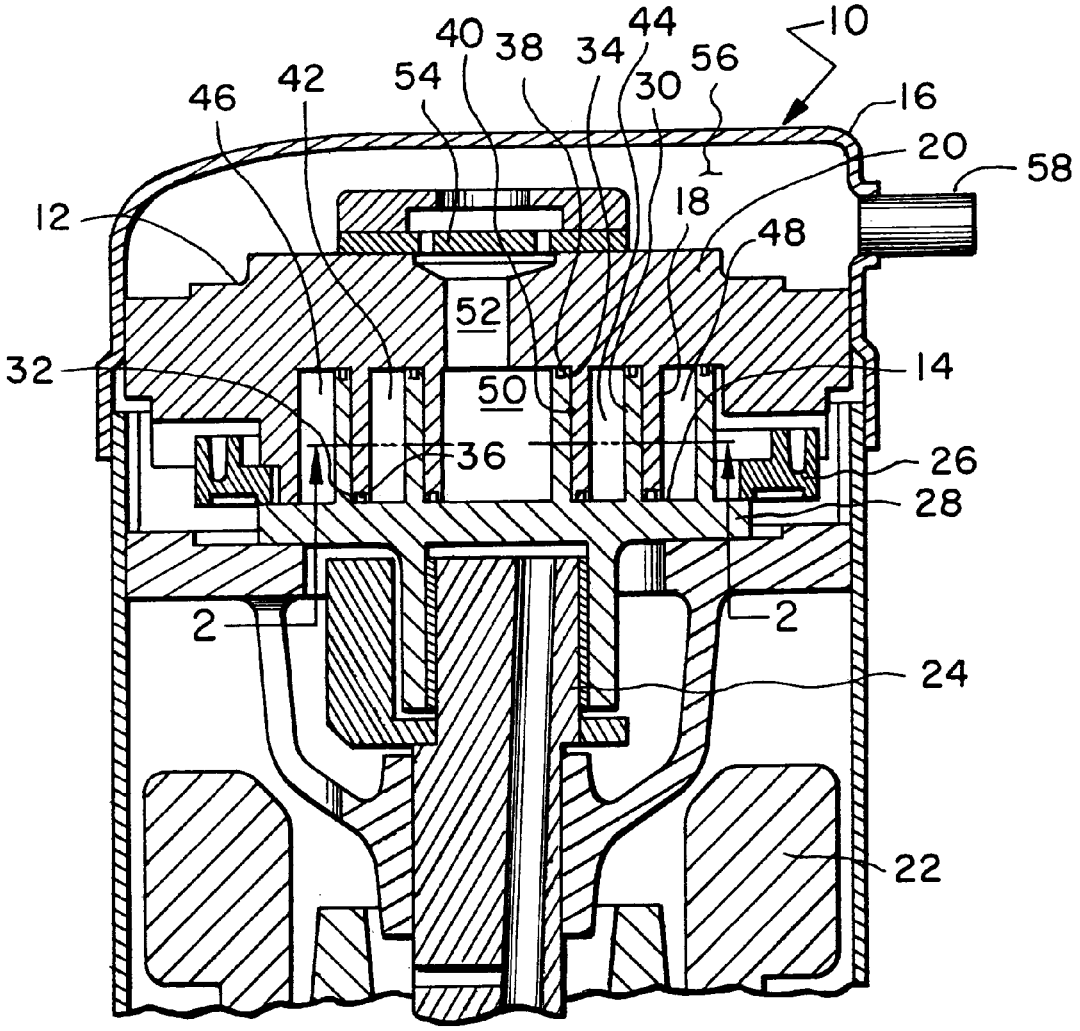
FIG. 1 is a cross-sectional view of the upper portion of a scroll compressor, illustrating the scroll members thereof in their interleaved relationship and the disposition of tip seals in the tips of the involute wraps thereof.

Referring initially to Drawing FIGS. 1, 2 and 3, compressor 10 has a first scroll member 12 and a second scroll member 14. Scroll member 12 is fixedly mounted within the shell 16 of compressor 10 and has an involute wrap 18 extending from its end plate 20.

Second scroll member 14 is driven by motor 22 through drive shaft 24 and is constrained, by Oldham coupling 26, to orbital motion with respect to fixed scroll member 12. Orbiting scroll member 14 has an end plate 28 and an involute wrap 30 extending therefrom into interleaved engagement with involute wrap 18 of fixed scroll member 12. At least one of the scroll members (most often the fixed scroll member) will be fabricated from cast iron. As will be apparent, any tip seal that bears against such material must be durable and, in a compressor application, able to function in a high temperature environment.

A groove 32 is defined in the tip of involute wrap 18 while a groove 34 is defined in the tip of involute wrap 30. Tip seal 36 and tip seal 38, which will subsequently be more thoroughly described, are generally rectangular in nature and are disposed in tip seal grooves 32 and 34 respectively. Tip seals 36 and 38 seal against both the end plate of the opposing scroll member and the radially outermore sidewalls 37 and 39 of the groove in the tip of the involute wrap in which they are disposed.

Referring more particularly now to FIGS. 2 and 3, sealing against the outermore groove sidewall results, at least in part, from the fact that the pressure in the radially outermore compression pockets LP defined by the scroll wraps will be less than the pressure in the radially innermore compression pockets HP because the radially innermore compression pockets are of smaller volume and therefore contain gas at higher pressure. Tip seals are often biased both into contact with the sidewall of the groove in which they are disposed and out of the groove and into contact with the opposing scroll end plate by the higher pressure gas located in the radially innermore compression pockets.

Involute wraps 18 and 30 are seen to be in interleaved engagement with each other, there being moving line contact or near contact (in the case of fixed throw compressors) between or at the flanks of the scroll wraps at the locations designated by the numeral 40 in these drawing figures. Such lines of contact or near contact define moving boundaries and cooperate in the definition of compression pockets 42, 44, 46 and 48 when the involute wraps of the scroll members are in the relative positions illustrated in FIG. 3.

Discharge pocket 50, in FIG. 2, is in flow communication with discharge port 52 through which compressed discharge gas exits the scroll set. The discharge gas flows out of discharge port 52, through discharge check valve 54 and out of discharge pressure portion 56 of the compressor prior to exiting compressor shell 16 through discharge fitting 58. Compression pockets 46 and 48 are the radially outermore, lower pressure compression pockets LP while compression pockets 42 and 44 are the radially innermore, higher pressure compression pockets HP. The pressure in discharge pocket 50, which is the radially innermost compressor pocket is higher still than the pressure in HP compression pockets 42 and 44.

In addition to their flank-to-flank boundaries of moving line contact or near contact, compression pockets 42, 44, 46, 48 are defined by the end plates of the two scroll members and the contact of those end plates with the tip of the wrap of the opposing scroll member or a tip seal disposed therein. As earlier mentioned, the moving lines of contact or near contact running through points 40 along the upstanding flank or sidewall surfaces of the interleaved scroll wraps, together with either direct contact between the tips of the involute wraps and the opposing scroll member end plate or the contact of tip seals disposed in the tips of the involute wraps with the end plate of the opposing scroll member, cooperate to define the compression pockets. Such contact or near contact together with the sealing of the pockets, most often by lubricant which is entrained in the gas undergoing compression or which is injected into that gas, results in essentially leakage free compression pockets which, when the compressor is in operation, are continuously formed, close and are displaced radially inward into communication with discharge port 52 by the relative orbital motion of the scroll members.

If compression pockets 42, 44, 46 and 48 are not maintained as essentially closed, sealed pockets through direct or near direct scroll member to scroll member contact, through the use of lubricant to seal them and/or through the use of tip seals, leakage across wrap tips or via wrap flanks from the radially innermore compression pockets, which will contain gas at a relatively higher pressure, to the radially outermore compression pockets or back to suction will occur as a result of the pressure differential therebetween. The amount of such leakage is a direct and important factor in determining the efficiency of a scroll compressor. It will be appreciated that as orbiting scroll member 14 continues to rotate, HP compression pockets 46 and 48 will eventually be displaced radially inward until they come into communication with each other and form a new discharge pocket, LP pockets 42 and 44 will be displaced radially further inward and become higher pressure pockets HP and new lower pressure compression pockets LP will be formed.

Figure 4:
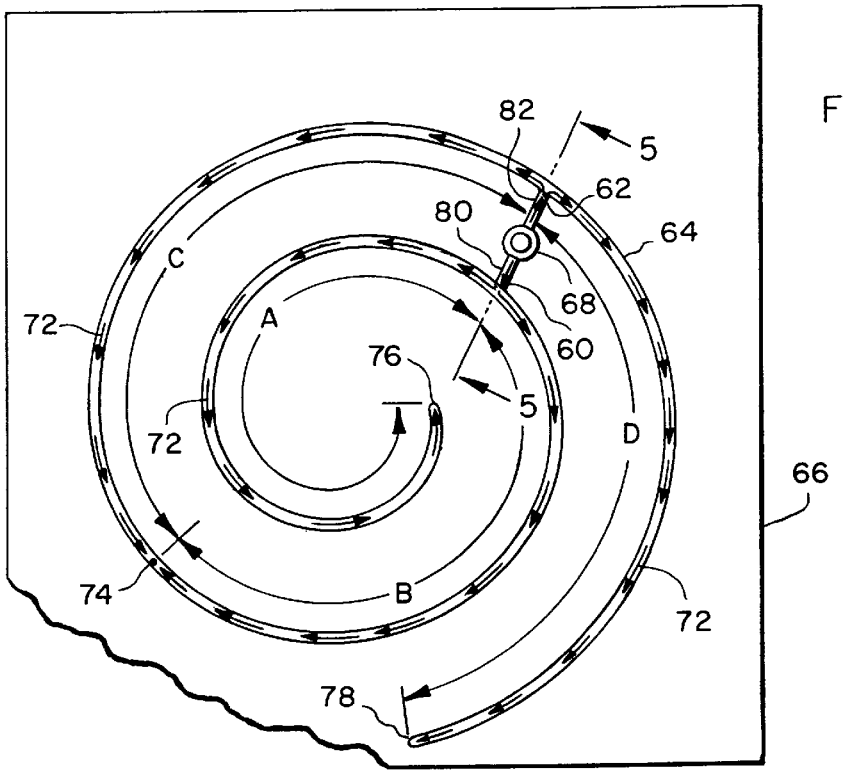
FIG. 4 is illustrative of the shape of the cavity defined by the mold for the tip seal of the present invention.
Figure 5:
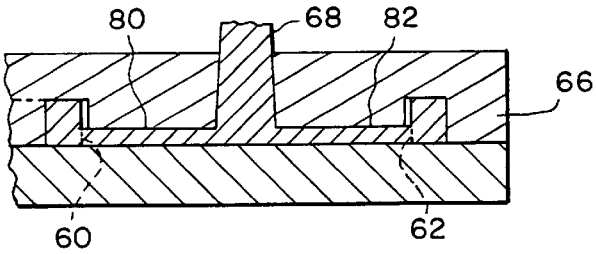
FIG. 5 is a view taken along lines 5—5 of FIG. 4.
Figure 6:
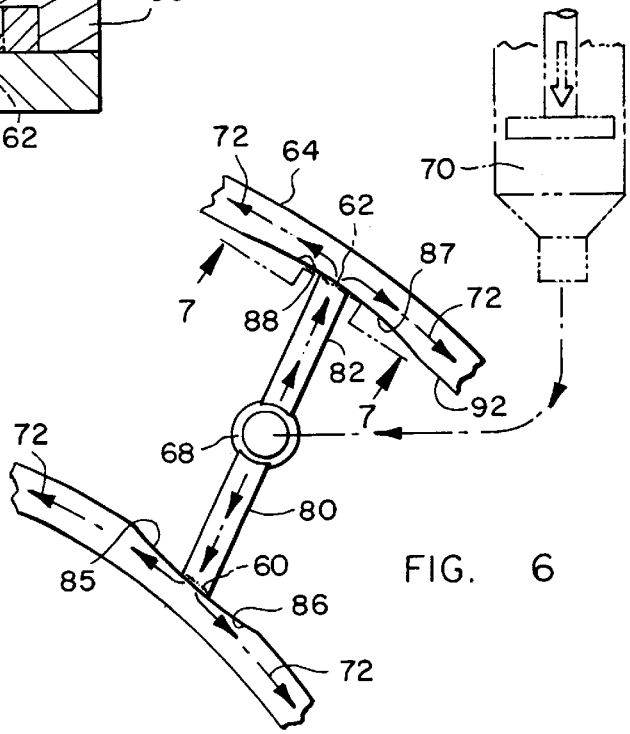
FIG. 6 is an enlarged partial view of FIG. 4—4 in the area of injection into the mold cavity.

Referring additionally now to Drawings FIGS. 4, 5 and 6, it will come to be appreciated that tip seals 36 and 38 are, in the present invention, unitary single piece elements that are injection molded. The material from which tip seals 36 and 38 are fabricated is preferably a polyetheretherkeytone base material which has been alloyed with, preferably, 20% by weight carbon fiber and 15% by weight polytetrafluoroethylene (PTFE). It should be noted that the percentage by weight of carbon fibers found to be acceptable and usable in such tip seals ranges from 10% to 30% while the percentage of polytetrafluoroethylene by weight will range from 5% to 15% (or slightly more) with 15% appearing to be optimal for this particular application.

Even in the semi-fluidic state in which it is injected into the mold used to form tip seals 36 and 38, the carbon fiber, polytetrafluoroethylene alloyed PEEK used to fabricate the tip seals of the present invention is extremely viscous. Given that a tip seal has a relatively very long axial or "unwound" length but a relatively very tiny cross-sectional area, it will be appreciated that forcing such extremely viscous material into a mold which defines the small cross-section but relatively long involute geometry of a tip seal has proven to be extremely difficult. Initial efforts, in fact, to force such tip seal material completely into a mold cavity through a single point of entry or ingate to the mold cavity failed even when the tip seal material was heated to temperatures which caused a breakdown in its end properties.

The difficulties associated with injecting the carbon fiber, polytetrafluoroethylene alloyed PEEK into such a mold have, however, been overcome in the present invention by use of a mold employing two ingates 60 and 62 to feed cavity 64 of mold 66. Ingates 60 and 62 are, in turn, fed through a single sprue 68 into which the tip seal material is injected from a source 70 of such material.

Flow of the base tip seal material into the mold cavity is enhanced by the employment of a small percentage of a so-called flow enhancer additive. Such additives are readily available but are typically proprietary to those companies known in the engineered materials industry as "custom blenders". The use of such a flow enhancing or "high flow" additive still further facilitates the tip seal molding process although absent the injection methodology of the present invention, even the use of such flow enhancing additives did not permit the injection molding of carbon fiber, polytetrafluoroethylene alloyed PEEK materials into a tip seal mold through a single ingate.

Ingates 60 and 62 are positioned with respect to the geometry of tip seals 36 and 38 and mold cavity 64 in which they are formed such that no portion of the highly viscous base material need flow more than one-quarter of the length of the mold cavity. Travel of the material through the mold cavity out of each of ingates 60 and 62 is bi-directional, as illustrated by arrows 72, and the length of such travel is, once again, equal in each of the four segments A, B, C and D into which the length of the mold cavity (and a tip seal formed in it) is divided by the appropriate positioning of the ingates. The use of only two ingates is advantageous in terms of ensuring the homogeneity of the tip seal in that it results in only a single "butt" joint in the tip seal as will subsequently be described.

As the tip seal material flows into sprue 68, its flow diverges and proceeds bi-directionally to ingates 60 and 62. Upon entering ingates 60 and 62, the material flow once again diverges and proceeds bi-directionally into mold cavity 64. One portion of the material flow that enters cavity 64 through ingate 60 will flow into and meet a portion of the other flow that enters cavity 64 through ingate 62 in location 74 within the mold cavity.

That meeting of material flows at location 74, with the material then being in a heated semi-fluidic state, will result in the mixture of the two opposing flows at their point of contact and the formation of a "butt" joint at the location of the meeting when the material cools and sets. While there would preferably be no such joints in a tip seal since they do, prospectively, represent a prospective point of nonhomogeneity, the fact that the 15% polytetrafluoroethylene, 20% carbon fiber alloyed PEEK material can be used to form a tip seal at temperatures that do not cause a breakdown in its superior properties in a tip seal application outweighs the potential negatives associated with the existence of a butt joint in the final tip seal product.

The other two material flows proceed in opposite directions through mold cavity 64 until they reach the innermost end 76 and outermost end 78 thereof. By positioning ingates 60 and 62 appropriately, the four material flows that occur within cavity 64 cover, once again, the same but a much reduced distance as compared to the overall length of the mold cavity while limiting the number of butt joints in the resulting tip seal to one.

It is noted that the tip seal is left to cool and set in the mold with the result that it must, prior to use, be broken away or disassociated from the unused portion of the material that fills sprue 68 and the passages 80 and 82 that lead to ingates 60 and 62 in mold 66. In the present invention, such excess material is disposed of simply by breaking or clipping it off, once it has cooled and set, from the sidewall of tip seal element to which it is attached, such as at location 84 illustrated in the tip seal of FIG. 7. This location represents an area of extremely small cross section making the excess material that needs to be removed from the tip seal very easy to break or clip off without damaging or affecting the viability of the tip seal itself.

It is important to note that very slight, curved concavities 85 and 87 are caused to exist in the tip seals at the ingate locations by providing slight bulges or convexities 86 and 88 in mold 66 at the location of ingates 60 and 62 into the mold cavity. The breaking off/clipping of the excess material from the tip seal in these locations, once the tip seal has set in the mold and been removed from it, results in a roughened, slightly protruding area or gate trace 90 in each such location.

Figure 7:
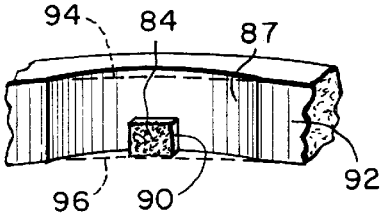
FIG. 7 is a partial view of a tip seal resulting from the injection of a tip seal material into the mold cavity of FIG. 6 taken along line 7—7 thereof and illustrating a gate trace location.

Gate trace 90, even though projecting very slightly from concavity 87 in the sidewall 92 of the tip seal on which it is formed, does not project beyond the involute curvature, represented by dashed lines 94 and 96 in FIG. 7, of the sidewall itself. As such, no special or intricate process is required to remove the excess material from the tip seal or to finish the sidewall of the tip seal in the location of a gate trace. In the present invention, one gate trace will be formed on a first sidewall of the tip seal and a second gate trace will be formed on a second sidewall. Because gate trace 90 does not project beyond the involute curvature of the sidewall of the tip seal, it will not, as was noted with respect to other recent tip seal designs, interfere with the sealing operation of the tip seal in a location where such gate trace is on a sidewall that engages a side of the groove in the tip of the involute wrap in which it is disposed for sealing purposes.

In sum, the tip seal of the present invention, its method of fabrication and the materials from which it is fabricated all result in a highly superior, injection moldable unitary tip seal element that is economic to fabricate, easy to install and which exhibits superior flexibility, sealing and wear resistance characteristics in use.

While the present invention has been described in terms of a preferred embodiment, it will be appreciated that modifications thereto will be apparent to those skilled in the art that lie within the scope of the invention.

What is claimed is:

1. An injection-molded tip seal for mounting in a groove in the involute wrap of a scroll member of a scroll compressor comprising a unitary member having two gate traces and one butt joint, said tip seal being rectangular in nature and one of said gate traces being located on one side wall of said tip seal, the second of said gate traces being located on a second side wall of said tip seal.

2. The tip seal according to claim 1 wherein one of said gate traces is located at a first distance from a first end of said tip seal and the second of said gate traces is located at a second distance from the second end of said tip seal, said first distance and said second distance generally being equal.

3. The tip seal according to claim 2 wherein said generally equal first and second distances are approximately one-fourth of the overall length of said tip seal.

4. The tip seal according to claim 3 wherein said first and said second gate traces are each located in a concavity in the one of said sidewalls of said tip seal in which it is formed.

5. The tip seal according to claim 4 wherein said gate traces do not extend beyond the curvature of the sidewall of the tip seal in which they are formed.

6. The tip seal according to claim 1, a first concavity being formed in said first sidewall and a second concavity being formed in said second sidewall, said two gate traces being located, one each, in one of said concavities.

7. The tip seal according to claim 6 wherein one of said concavities is located at a first distance from a first end of said tip seal and the second of said concavities is located at a second distance from the second end of said tip seal, said first distance and said second distance generally being equal.

8. The tip seal according to claim 7 wherein said first distance and said second distance are approximately the same and are approximately one-fourth of the overall length of said tip seal.

9. The tip seal according to claim 1 wherein one of said gate traces is located in a first concavity in said first sidewall of said tip seal and the second of said gate traces is located in a second concavity in said second sidewall of said tip seal, said first concavity being located at a distance from a first end of said tip seal which equals approximately one-quarter the length of said tip seal and said second concavity is located at a distance from a second end of said tip seal which equals approximately one-quarter of the length of said tip seal.

* * * * *